US012435400B2

(12) United States Patent
Na et al.

(10) Patent No.: US 12,435,400 B2
(45) Date of Patent: Oct. 7, 2025

(54) THICK COMPOSITE-PHASE STEEL HAVING EXCELLENT DURABILITY AND MANUFACTURING METHOD THEREFOR

(71) Applicant: POSCO, Pohang-si (KR)

(72) Inventors: Hyun-Taek Na, Gwangyang-si (KR); Sung-Il Kim, Gwangyang-si (KR)

(73) Assignee: POSCO, Pohang-si (KR)

( * ) Notice: Subject to any disclaimer, the term of this patent is extended or adjusted under 35 U.S.C. 154(b) by 531 days.

(21) Appl. No.: 17/779,096

(22) PCT Filed: Nov. 26, 2020

(86) PCT No.: PCT/KR2020/016925

§ 371 (c)(1),
(2) Date: May 23, 2022

(87) PCT Pub. No.: WO2021/112488

PCT Pub. Date: Jun. 10, 2021

(65) Prior Publication Data

US 2022/0403489 A1 Dec. 22, 2022

(30) Foreign Application Priority Data

Dec. 2, 2019 (KR) ..... 10-2019-0158289

(51) Int. Cl.
*C22C 38/26* (2006.01)
*C21D 8/02* (2006.01)
(Continued)

(52) U.S. Cl.
CPC ..... *C22C 38/26* (2013.01); *C21D 8/0226* (2013.01); *C22C 38/28* (2013.01); *C22C 38/38* (2013.01);
(Continued)

(58) Field of Classification Search
CPC ..... C22C 38/26; C22C 38/28; C22C 38/38; C22C 38/02; C22C 38/04; C21D 8/0226;
(Continued)

(56) References Cited

U.S. PATENT DOCUMENTS

2014/0007993 A1 1/2014 Nakajima et al.
2014/0144552 A1 5/2014 Kami et al.
(Continued)

FOREIGN PATENT DOCUMENTS

CN 109477185 3/2019
CN 109563601 4/2019
(Continued)

OTHER PUBLICATIONS

Chinese Office Action—Chinese Application No. 202080077393.X issued on Dec. 23, 2022, citing CN 109563601, CN 109477185, and KR 10-2017-0071658.
(Continued)

*Primary Examiner* — Sally A Merkling
*Assistant Examiner* — Danny N Kang
(74) *Attorney, Agent, or Firm* — CANTOR COLBURN LLP

(57) ABSTRACT

Provided are thick hot-rolled composite-phase steel having excellent durability and a manufacturing method therefor. The thick composite-phase steel having excellent durability according to the present invention comprises, by wt %, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, Fe, and inevitable impurities, and has a mixed phase of ferrite and bainite as a base structure, wherein, in the base structure, the area fraction of each of a pearlite phase and a martensite and austenite (MA) phase is less than 5%, and the area fraction of a martensite phase is less than 10%.

4 Claims, 1 Drawing Sheet

(51) Int. Cl.

| | |
|---|---|
| ***C22C 38/28*** | (2006.01) |
| ***C22C 38/38*** | (2006.01) |
| ***C23C 2/06*** | (2006.01) |

(52) U.S. Cl.
CPC ..... *C23C 2/06* (2013.01); *C21D 2211/002* (2013.01); *C21D 2211/005* (2013.01)

(58) Field of Classification Search
CPC ..... C21D 2211/002; C21D 2211/005; C21D 1/02; C21D 8/0205; C21D 8/0263; C21D 9/46; C21D 2211/008; C21D 2221/01; C21D 8/0273; C23C 2/06; C23C 2/02; C23C 2/12; C23C 30/00
See application file for complete search history.

(56) References Cited

U.S. PATENT DOCUMENTS

| | | | |
|---|---|---|---|
| 2017/0159149 | A1 | 6/2017 | Toyoda et al. |
| 2017/0183750 | A1 | 6/2017 | Miura et al. |
| 2018/0371570 | A1 | 12/2018 | Kim et al. |
| 2019/0161822 | A1 | 5/2019 | Takashima et al. |
| 2019/0226061 | A1 | 7/2019 | Sano et al. |
| 2021/0010098 | A1 | 1/2021 | Na et al. |

FOREIGN PATENT DOCUMENTS

| | | | |
|---|---|---|---|
| JP | H08143952 | A | 6/1996 |
| JP | H09143570 | | 6/1997 |
| JP | H11106861 | | 4/1999 |
| JP | H11140542 | | 5/1999 |
| JP | H11310852 | A | 11/1999 |
| JP | 2010174343 | | 8/2010 |
| JP | 2016130334 | A | 7/2016 |
| JP | 2016141848 | | 8/2016 |
| JP | 2018016873 | A | 2/2018 |
| JP | 2019527774 | A | 10/2019 |
| KR | 20000043432 | | 7/2000 |
| KR | 20010060647 | | 7/2001 |
| KR | 100723200 | | 5/2007 |
| KR | 20150041934 | | 4/2015 |
| KR | 101528084 | | 6/2015 |
| KR | 20150074943 | | 7/2015 |
| KR | 20150075541 | | 7/2015 |
| KR | 20160140802 | | 12/2016 |
| KR | 20160145794 | | 12/2016 |
| KR | 20170071658 | | 6/2017 |
| KR | 101797383 | | 11/2017 |
| KR | 101797383 | B1 * | 11/2017 |
| KR | 101988765 | | 6/2019 |
| WO | 2018026014 | A1 | 2/2018 |

OTHER PUBLICATIONS

European Search Report—European Application No. 20896577.2 issued on Nov. 28, 2022, citing Stewart et al., US 2014/0007993, and US 2014/0144552.

Stewart et al., Quenching and Partitioning of Plate Steels: Partitioning Design Methodology, Metallurgical and Materials Transactions A, Oct. 2019, vol. 50A, pp. 4701-4713.

International Search Report—PCT/KR2020/016925 dated Mar. 3, 2021.

Japanese Office Action—Japanese Application No. 2022-532567 issued on Jul. 18, 2023, citing JP H08-143952, WO 2018/026014, JP H11-310852, JP 2019-527774, JP 2016-130334, and JP 2018-016873.

* cited by examiner

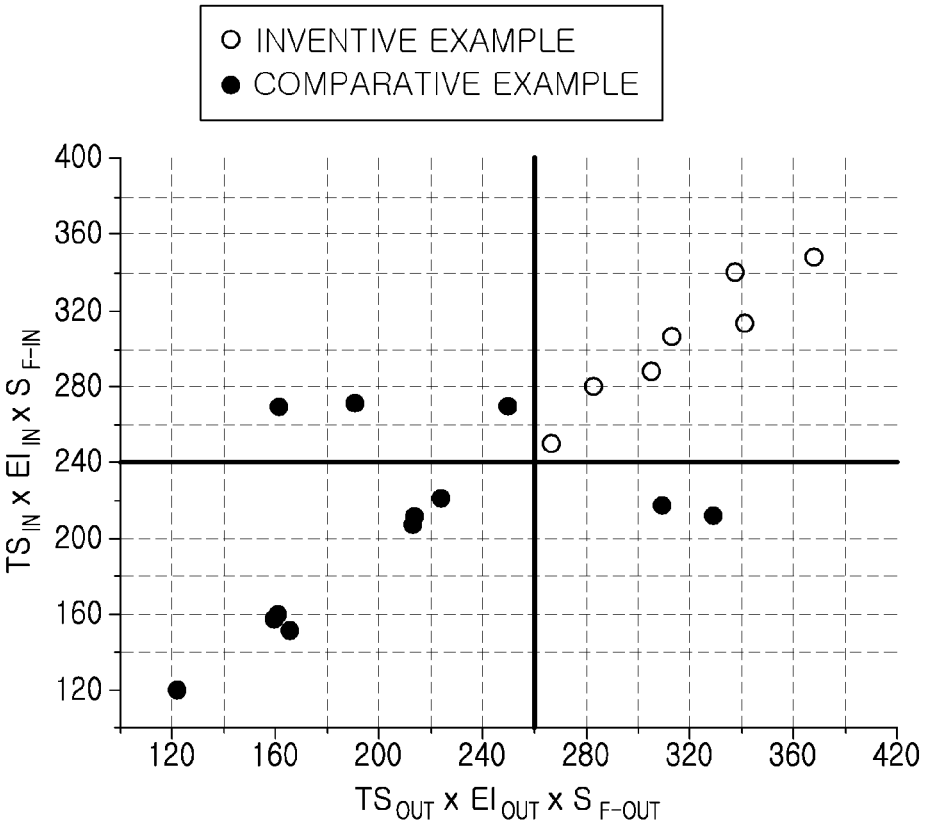
INVENTIVE EXAMPLE
COMPARATIVE EXAMPLE
400
360
320
280
240
200
160
120
120
160
200
240
280
320
360
420
TS IN x EI IN x S F-IN
TS OUT x EI OUT x S F-OUT

THICK COMPOSITE-PHASE STEEL HAVING EXCELLENT DURABILITY AND MANUFACTURING METHOD THEREFOR

TECHNICAL FIELD

The present invention mainly relates to manufacturing of a high-strength hot-rolled steel sheet having a thickness of 5 mm or more, used for members of a chassis part and a wheel rim of a commercial vehicle, and more particularly, to high-strength thick hot-rolled composite-phase steel in which a product of tensile strength×fatigue strength and elongation×fatigue strength of a steel sheet after punching forming is uniform in a lengthwise direction of a coil due to a tensile strength of 650 MPa or more and excellent cross-sectional quality during shear forming and punching forming, and a manufacturing method therefor.

BACKGROUND ART

In order to secure high rigidity of members of chassis parts and wheel rims of commercial vehicles due to characteristics of the vehicles, the conventional high-strength hot-rolled steel sheet having a thickness of 5 mm or more and a tensile strength of 440 to 590 MPa has been used, but recently, a technology of using high-strength steel having a tensile strength of 650 MPa or more is being developed for weight reduction and high strength. In addition, in order to increase the weight reduction efficiency, parts are manufactured by being subjected to shear forming and multiple punching forming during the manufacturing of the parts within a range in which durability is secured, resulting in shortening a durability lifespan of parts with minute cracks formed in punched portions of a steel sheet during the shear and punching forming.

In this regard, as the related art, a technology (Patent Documents 1 and 2) of using a ferrite phase as a matrix structure by coiling at a high temperature after performing typical hot rolling in austenite region and finely forming precipitates has been proposed. Also, a technology (Patent Document 3) of performing coiling after cooling a coiling temperature to a temperature at which a bainite phase is formed into a matrix structure so as not to form the coarse pearlite structure, etc., have been proposed. In addition, a technology (Patent Document 4) for refining austenite grains by applying a pressure of 40% or more in a non-recrystallization region during the hot rolling using Ti, Nb, etc., has also been proposed.

However, alloy components such as Si, Mn, Al, Mo, and Cr, which are mainly used to manufacture such high-strength steels, are effective in improving the strength of the hot-rolled steel sheet, so it is necessary for thick products for commercial vehicles. However, when a lot of alloy components are added, since non-uniformity may be caused in a microstructure, during the shear or punching forming, microcracks that are easily generated in the punched portion are easily propagated to fatigue cracks in a fatigue environment, resulting in damage to parts. In particular, as a thickness of the steel sheet increases, a likelihood of a center in the thickness of the steel sheet being slowly cooled during manufacturing increases, so that non-uniformity of the structure further increases and the propagation speed of fatigue cracks also increases in the fatigue environment, resulting in deteriorating the durability.

However, the above-described related art does not take into account fatigue properties of a high-strength thick material. In addition, it is effective to use precipitate-forming elements such as Ti, Nb, and V to refine grains of the thick material and obtain a precipitation strengthening effect. However, when the coiling is carried out at a high temperature of 500 to 700° C. which is easy to form precipitates, or a cooling rate of the steel sheet is not controlled during the cooling after hot rolling, coarse carbides are formed in the center in a thickness of the thick material, so the quality of the shear surface quality deteriorates, and furthermore, applying a 40% pressure reduction in the non-recrystallization region during the hot rolling deteriorates the quality of the shape of the rolled sheet and increases a load on the equipment, making it difficult to apply in practice.

RELATED ART DOCUMENT

Patent Document (Patent Document 1) Japanese Patent Laid-Open Publication No. 5-308808
(Patent Document 2) Japanese Patent Laid-Open Publication No. 5-279379
(Patent Document 3) Korea Patent No. 10-1528084
(Patent Document 4) Japanese Patent Laid-Open Publication No. 9-143570

DISCLOSURE

Technical Problem

The present invention provides high-strength thick hot-rolled composite-phase steel in which a product of tensile strength×fatigue strength and elongation×fatigue strength of a steel sheet after punching forming is uniform in a lengthwise direction of a coil due to a tensile strength of 650 MPa or more and excellent cross-sectional quality during shear forming and punching forming, and a manufacturing method therefor.

An object of the present invention is not limited to the above-described contents. The problems of the present invention will be understood from the overall content of this specification, and those of ordinary skill in the art to which the present invention pertains will have no difficulty in understanding additional problems of the present invention.

Technical Solution

According to an aspect of the present invention, composite-phase steel having excellent material and durability uniformity and a thickness of 5 mm or more may include: by wt %, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, Fe, and inevitable impurities, and a mixed phase of ferrite and bainite as a base structure, wherein, in the base structure, an area fraction of each of a pearlite phase and a martensite and austenite (MA) phase is less than 5%, and an area fraction of a martensite phase is less than 10%, and when a coil in a wound state is divided, in a lengthwise direction, into three parts: HEAD, MID, and TAIL parts, a product of tensile strength, elongation, and fatigue strength of an outer wound portion of the coil, which is a region of the HEAD part and the TAIL part, is $25\times10^5$% or greater, and a product of tensile strength, elongation, and fatigue strength of an inner wound portion of the coil, which is a region of the MID part, is $24\times10^5$% or greater.

The area fraction of the ferrite and the bainite may be less than 65%, respectively.

The composite-phase steel may be a pickled and oiled (PO) steel sheet.

The composite-phase steel may be a hot-dip galvanized steel sheet having a hot-dip galvanized layer formed on at least one surface thereof.

According to an aspect of the present invention, a manufacturing method of composite-phase steel having excellent material and durability uniformity and a thickness of 5 mm or more may include: reheating a steel slab including, by wt %, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti 0.005 to 0.11%, Fe and unavoidable impurities at a temperature of 1200 to 1350° C.;

manufacturing a hot-rolled steel sheet by finish hot rolling the reheated steel slab at a finish hot rolling temperature (FDT) satisfying the following [Relational Expression 1] of steel;

primarily cooling the hot-rolled steel sheet to a mid-temperature (MT) range of 550 to 650° C. to satisfy the following [Relational Expression 2]; and when the primarily cooled steel sheet is divided, in a lengthwise direction, into three parts: HEAD, MID, and TAIL parts, secondarily cooling a region of the HEAD part and the TAIL part corresponding to an outer wound portion of a coil during coiling to a temperature range from 450 to 550° C. to satisfy the following [Relational Expression 3], and secondarily cooling a region of the MID part corresponding to an inner wound portion of the coil during coiling to a temperature range from 400 to 500° C. to satisfy the following [Relational Expression 4], and then coiling the cooled region of the MID part;

$$Tn-60\leq FDT\leq Tn$$

$$Tn=740+92[C]-80[Si]+70[Mn]+45[Cr]+650[Nb]+410[Ti]-1.4(t-5) \quad \text{[Relational Expression 1]}$$

the FDT of the above Relational Expression 1 is a finish hot-rolling temperature (° C.),

[C], [Si], [Mn], [Cr], [Nb], and [Ti] in the above Relational Expression 1 are wt % of the corresponding alloy element, t of the above Relational Expression 1 is a thickness of a final hot-rolled sheet (mm)

$$CR1_{min}<CR1<CR1_{max}$$

$$CR1_{min}=210-850[C]+1.5[Si]-67.2[Mn]-59.6[Cr]+187[Ti]+852[Nb]$$

$$CR1_{max}=240-850[C]+1.5[Si]-67.2[Mn]-59.6[Cr]+187[Ti]+852[Nb] \quad \text{[Relational Expression 2]}$$

$CR_1$ of the above Relational Expression 2 is a primary cooling rate (° C./sec) in an FDT to MT (550 to 650° C.) section,

[C], [Si], [Mn], [Cr], [Ti], and [Nb] in the above Relational Expression 2 are wt % of the corresponding alloy element $$CR2_{OUT-min}<CR2_{OUT}<CR2_{OUT-max}$$

$$CR2_{OUT-min}=14.5[C]+18.75[Si]+8.75[Mn]+8.5[Cr]+35.25[Ti]+42.5[Nb]-14$$

$$CR2_{OUT-max}=38.7[C]+50[Si]+23.3[Mn]+22.7[Cr]+94[Ti]+113.3[Nb]-37.4 \quad \text{[Relational Expression 3]}$$

$CR2_{OUT}$ of the above Relational Expression 3 is the secondary cooling rate (° C./sec) in MT to coiling temperature section of the HEAD part and the TAIL part,

[C], [Si], [Mn], [Cr], [Ti], and [Nb] in the above Relational Expression 3 are wt % of the corresponding alloy element $$CR2_{IN-min}<CR2_{IN-max}$$

$$CR2_{IN-min}=29[C]+37.5[Si]+17.5[Mn]+17[Cr]+20.5[Ti]+25[Nb]-28$$

$$CR2_{IN-max}=211.5[C]+5.5[Si]+15[Mn]+6[Cr]+30.5[Ti]+41[Nb]+30.5 \quad \text{[Relational Expression 4]}$$

$CR2_{IN}$ of the above Relational Expression 4 is the secondary cooling rate (° C./sec) in MT to coiling temperature section of the MID part,

[C], [Si], [Mn], [Cr], [Ti], and [Nb] in the above Relational Expression 4 are wt % structure of the corresponding alloy element.

The composite-phase steel may have a mixed phase of ferrite and bainite as a base structure, in the base structure, an area fraction of each of a pearlite phase and a martensite and austenite (MA) phase may be less than 5%, and an area fraction of a martensite phase may be less than 10%, and a product of tensile strength, elongation, and fatigue strength of the outer wound portion of the coil, which is the region of the HEAD part and the TAIL part, may be $25\times10^5$% or greater, and a product of tensile strength, elongation, and fatigue strength of the inner wound portion of the coil, which is the region of the MID part, may be $24\times10^5$% or greater.

The manufacturing method may further include pickling and oiling the coiled steel sheet after the secondary cooling.

The manufacturing method may further include heating the pickled or oiled steel sheet to a temperature range from 450 to 740° C., and then hot-dip galvanizing the steel sheet.

The hot-dip galvanizing may be formed using a plating bath including, by wt %, magnesium (Mg): 0.01 to 30%, Al: 0.01 to 50%, the remaining of Zn, and inevitable impurities.

Advantageous Effects

According to the present invention of the above configuration, it is possible to effectively provide a high-strength thick composite-phase steel sheet having excellent material and durability uniformity and a tensile strength of 650 MPa or more, and having, as a base structure, a mixed phase of ferrite and bainite phases each having an area fraction of less than 65%, in which, in a microstructure in a center of a thickness, an area fraction of each of a pearlite phase and a martensite and austenite (MA) phase is less than 5% and an area fraction of a martensite phase is less than 10%, and a product of tensile strength, elongation, and fatigue strength of an outer wound portion is $25\times10^5$% or greater, and a product of tensile strength, elongation, and fatigue strength of an inner wound portion is $24\times10^5$% or greater.

BRIEF DESCRIPTION OF THE DRAWINGS

FIG. 1 is a diagram illustrating a product of tensile strength, elongation, and fatigue strength of an outer wound portion and an inner wound portion of a wound coil according to an embodiment of the present invention.

BEST MODE

Hereinafter, the present invention will be described.

In order to solve the problems of the related art described above, the present inventors investigated a crack distribution and durability changes in a shear plane according to characteristics of alloy components and microstructures for thick materials with different microstructures based on various alloy compositions, and as a result, derived Relational Expressions 1 to 4 to be described later. That is, the present inventors confirmed that, by controlling a steel alloy composition range and controlling steel manufacturing process conditions to satisfy Relational Expressions 1 to 4, it is possible to manufacture high-strength thick composite-phase steel sheet having excellent material and durability uniformity and a tensile strength of 650 MPa or more, and having, as a base structure, a mixed phase of ferrite and bainite phases in which, in a microstructure in a center of a thickness of a steel sheet, an area fraction of each of a pearlite phase and a martensite and austenite (MA) phase is less than 5% and an area fraction of a martensite phase is less than 10%, and a product of tensile strength, elongation, and fatigue strength of an outer wound portion of a coil is $25\times10^5$% or greater, and a product of tensile strength, elongation, and fatigue strength of an inner wound portion is $24\times10^5$% or greater, and proposed the present invention.

The thick composite-phase steel having excellent material and durability uniformity includes, by wt %, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, Fe, and inevitable impurities, and has a mixed phase of ferrite and bainite as a base structure, wherein, in the base structure, the area fraction of each of a pearlite phase and a martensite and austenite (MA) phase is less than 5%, and the area fraction of a martensite phase is less than 10%, and when a coil in a wound state is divided, in the lengthwise direction, into three parts: HEAD, MID, and TAIL parts, a product of tensile strength, elongation, and fatigue strength of an outer wound portion of the coil, which is a region of the HEAD part and the TAIL part, is $25\times10^5$% or greater, and a product tensile strength, elongation, and fatigue strength of an inner wound portion of the coil, which is a region of the MID part, is $24\times10^5$% or greater.

Hereinafter, the alloy composition components and the reasons for limiting the content of the present invention will be described. Meanwhile, in the following steel alloy components, "%" means "weight" unless otherwise specified.

C: 0.05 to 0.15%

C is the most economical and effective element for reinforcing steel, and when the amount added increases, a precipitation strengthening effect or a bainite phase fraction increases, thereby increasing a tensile strength. In addition, when the thickness of the hot-rolled steel sheet increases, the cooling rate in the center of the thickness during cooling after hot rolling is slow, so coarse carbide or pearlite is easy to form when the content of C is large. Therefore, when the content is less than 0.05%, it is difficult to obtain a sufficient reinforcing effect, and when the content exceeds 0.15%, there is a problem in that the shear formability deteriorates and the durability deteriorates due to the formation of the pearlite phase or coarse carbide in the center of the thickness, and the weldability also deteriorates. Therefore, in the present invention, the content of C is preferably limited to 0.05 to 0.15%. More preferably, the content of C is limited to 0.06 to 0.12%.

Si: 0.01 to 1.0%

Si deoxidizes a molten steel and has a solid solution strengthening effect, and is advantageous in improving the formability by delaying the formation of the coarse carbide. However, there is a problem that, when the content is less than 0.01%, the solid solution strengthening effect is small and the effect of delaying the formation of carbide is small, so it is difficult to improve the formability, and when the content exceeds 1.0%, a red scale due to Si is formed on a surface of the steel sheet during the hot rolling, thereby not only reducing the quality of the surface of the steel sheet, but also reducing ductility and weldability. Therefore, in the present invention, it is preferable to limit the content of Si in the range of 0.01 to 1.0%, and more preferably 0.2 to 0.7%.

Mn: 1.0 to 2.3%

Like Si, Mn is an effective element for solid solution strengthening of steel, and increases hardenability of steel to facilitate the formation of the bainite phase during the cooling after hot rolling. However, when the content is less than 1.0%, the above effects may not be obtained due to the addition, and when the content exceeds 2.3%, the hardenability greatly increases, so the martensite phase transformation is easy to occur, and a segregation portion is greatly developed in the center of the thickness when casting the slab in the casting process, and during the cooling after hot rolling, the microstructure in the thickness direction is formed non-uniformly, resulting in deteriorating the shear formability and durability. Therefore, in the present invention, the content of Mn is preferably limited to 1.0 to 2.3%. More preferably, the content of Mn is limited to the range of 1.1 to 2.0%.

Cr: 0.005 to 1.0%,

Cr solid-solution strengthens the steel and delays the ferrite phase transformation upon cooling, thereby helping to form the bainite at the coiling temperature. However, when the content is less than 0.005%, the above effects may not be obtained according to the addition, and when the content exceeds 1.0%, the ferrite transformation is excessively delayed, and thus, the elongation deteriorates due to the formation of the martensite phase. In addition, similar to Mn, the segregation portion in the center of the thickness is greatly developed, and the microstructure in the thickness direction is non-uniform, resulting in deteriorating the shear formability and durability. Therefore, in the present invention, the content of Cr is preferably limited to 0.005 to 1.0%. More preferably, the content of Cr is limited to 0.3 to 0.9%.

P: 0.001 to 0.05%

Like Si, P has the effect of strengthening the solid solution and promoting the ferrite transformation at the same time. However, when the content is less than 0.001%, it is economically disadvantageous because it requires a lot of manufacturing cost and it is insufficient to obtain strength, and when the content exceeds 0.05%, brittleness occurs due to grain boundary segregation, microcracks are easy to occur during forming, and the formability and durability greatly deteriorate. Therefore, it is preferable to control the content of P in the range of 0.001 to 0.05%.

S: 0.001 to 0.01%

S is an impurity present in steel. When the content exceeds 0.01%, S combines with Mn and the like to form non-metallic inclusions. As a result, there is a problem in that it is easy to cause microcracks during cutting of steel and greatly reduces the shear formability and durability. On the other hand, when the content is less than 0.001%, it takes a lot of time during a steelmaking operation, resulting in lowering productivity. Therefore, in the present invention, it is preferable to control the content of S in the range of 0.001 to 0.01%.

Sol.Al: 0.01 to 0.1%,

Sol.Al is a component mainly added for deoxidation. When the content is less than 0.01%, the effect of the addition is insufficient, and when the content exceeds 0.1%, the AlN combines with nitrogen to form AlN, so corner cracks are likely to occur in slab during the continuous casting, and defects are likely to occur due to the formation of inclusions. Therefore, in the present invention, it is preferable to control the content of S in the range of 0.01 to 0.1%.

N: 0.001 to 0.01%

N is a representative solid solution strengthening element together with C, and forms coarse precipitates together with Ti, Al, and the like. In general, the solid solution strengthening effect of N is superior to that of carbon, but there is a problem in that toughness is greatly reduced as the amount of N in steel increases. In addition, in order to prepare the steel to have N of less than 0.001%, it takes a lot of time during the steelmaking operation, resulting in lowering productivity. Therefore, in the present invention, it is preferable to control the content of N in the range of 0.001 to 0.01%.

Ti: 0.005 to 0.11%

Ti is a representative precipitation strengthening element and forms coarse TiN in steel due to a strong affinity with N. TiN has the effect of suppressing a growth of grains during a heating process for hot rolling. In addition, Ti remaining after reacting with nitrogen is dissolved in steel and combined with carbon to form TiC precipitates, which is a useful component for improving the strength of the steel. However, when the content of Ti is less than 0.005%, the above effects may not be obtained, and when the content of Ti content exceeds 0.11%, there is a problem in that collision resistance properties during forming deteriorate due to the generation of coarse TiN and the coarsening of the precipitates. Therefore, in the present invention, it is preferable to limit the content of Ti in the range of 0.005 to 0.11%, and more preferably to control the content of Ti in the range of 0.01 to 0.1%.

Nb: 0.005 to 0.06%

Nb is a representative precipitation strengthening element together with Ti, and is precipitated during the hot rolling, and thus, effectively improves the strength and impact toughness of steel due to the effect of grain refinement by the delayed recrystallization. However, when the content of Nb is less than 0.005%, the above effects may not be obtained, and when the content of Nb exceeds 0.06%, elongated grains are formed due to the excessive recrystallization delay during the hot rolling and the formability and durability deteriorate due to the formation of coarse composite precipitates. Therefore, in the present invention, it is preferable to limit the content of Nb in the range of 0.005 to 0.06%, and more preferably to control the content of Nb in the range of 0.01 to 0.06%.

The remaining component of the present invention is iron (Fe). However, in a general manufacturing process, unintended impurities may inevitably be mixed from a raw material or the surrounding environment, and thus, these impurities may not be excluded. Since these impurities are known to anyone of ordinary skill in the manufacturing process, all the contents are not specifically described in the present specification.

Meanwhile, in the present invention, the composite-phase steel has a mixed phase of ferrite and bainite as a base structure, and each of the ferrite and bainite may be included in less than 65 area %.

In addition, the pearlite phase and the martensite and austenite (MA) phase in the base structure may be included in an area fraction of less than 5% respectively, and a martensite phase may be included in an area fraction of less than 10%.

When the area fraction of the pearlite phase and martensite and austenite (MA) phase is 5% or more, respectively, there is a problem in that the local strain difference due to the difference in hardness between the base structure and other phases facilitates the occurrence of cracks due to stress concentration during deformation, resulting in deteriorating the fatigue properties.

In addition, when the area fraction of the martensite phase is 10% or more, there is a problem in that, as the fractions of the low-temperature ferrite phase and the bainite phase decrease, the occurrence of cracks during fatigue as described above is facilitated, and the elongation deteriorates.

Furthermore, in the composite-phase steel according to the present invention, when the coil in the wound state is divided, in the lengthwise direction, into three parts: HEAD, MID, and TAIL parts, the product of the tensile strength, elongation, and fatigue strength of the outer wound portion of the coil, which is the region of the HEAD part and the TAIL part, is $25\times10^5$% or greater, and the product of the tensile strength, elongation, and fatigue strength of the inner wound portion of the coil, which is the region of the MID part, is $24\times10^5$% or greater.

Next, the manufacturing method of the thick composite-phase steel of the present invention will be described in detail.

The manufacturing method of composite-phase steel according to the present invention includes: reheating a steel slab having the composition components as described above at a temperature of 1200 to 1350° C.; manufacturing a hot-rolled steel sheet by finish hot rolling the reheated steel slab at a finish hot rolling temperature (FDT) satisfying the following [Relational Expression 1] of steel; primarily cooling the hot-rolled steel sheet to a mid-temperature (MT) range of 550 to 650° C. to satisfy the following [Relational Expression 2]; and when the primarily cooled steel sheet is divided, in a lengthwise direction, into three parts: HEAD, MID, and TAIL parts, secondarily cooling a region of the HEAD part and the TAIL part corresponding to an outer wound portion of a coil during coiling to a temperature range from 450 to 550° C. to satisfy the following [Relational Expression 3], and secondarily cooling a region of the MID part corresponding to an inner wound portion of the coil to the temperature range from 400 to 500° C. to satisfy the following [Relational Expression 4], and then coiling the cooled region of the MID part.

First, in the present invention, the steel slab having the above composition component is reheated at a temperature of 1200 to 1350° C. In this case, when the reheating temperature is less than 1200° C., the precipitates are not sufficiently re-dissolved, so the formation of the precipitates in the process after the hot rolling decreases, and the coarse TiN remains. When the reheating temperature exceeds 1350° C., the strength decreases due to abnormal grain growth of austenite grains, so the reheating temperature is preferably limited to 1200 to 1350° C.

Next, in the present invention, the hot-rolled steel sheet is manufactured by performing the finish hot rolling on the reheated steel slab at the finish hot rolling temperature (FDT) that satisfies the following [Relational Expression 1] of the steel.

$$Tn-60 \leq FDT \leq Tn$$

$$Tn=740+92[C]-80[Si]+70[Mn]+45[Cr]+650[Nb]+410[Ti]-1.4(t-5) \quad \text{[Relational Expression 1]}$$

the FDT of the above Relational Expression 1 is a finish hot-rolled temperature (° C.),

[C], [Si], [Mn], [Cr], [Nb], and [Ti] in the above Relational Expression 1 are wt % of the corresponding alloy element, t of the above Relational Expression 1 is a thickness of a final hot-rolled sheet (mm)

The recrystallization delay during the hot rolling promotes the ferrite phase transformation during the phase transformation, thereby contributing to the formation of fine and uniform grains in the center of the thickness and increasing the strength and durability. In addition, due to the promotion of the ferrite phase transformation, the untransformed phase decreases during the cooling, and the fraction of the coarse MA phase and martensite phase decreases and the coarse carbide or pearlite structure decreases in the center of the thickness where the cooling rate is relatively slow, so the non-uniform structure of the hot-rolled steel sheet is resolved.

However, it is difficult to make the microstructure uniform in the center of the thickness of a thick material having a thickness of 5 mm or more, and when the hot rolling is performed at an excessively low temperature in order to obtain the effect of the recrystallization delay in the center of the thickness, the deformed structure is developed strongly at a t/4 position just below a surface layer of the rolled sheet thickness, and thus, the non-uniformity of the microstructure with the center of the thickness increases, so the microcracks are likely to occur in the non-uniform portion during the shear deformation or punching deformation, and the durability of the parts also deteriorates. Therefore, as shown in the above Relational Expression 1, the above effect may be obtained only when the hot rolling is completed at Tn temperature and Tn−60 which are the temperature at which the recrystallization delay starts to be suitable for the thick material.

If the rolling ends at a temperature higher than the temperature range suggested in the above Relational Expression 1, the microstructure of the steel is coarse and non-uniform, and the phase transformation is delayed to form the coarse MA phase and martensite phase, so fine cracks are excessively formed during the shear forming and punching forming, resulting in deteriorating the durability. On the other hand, when the rolling ends at a temperature lower than the temperature range presented in the above Relational Expression 1, in the thick high-strength steel having a thickness of more than 5 mm, a fine ferrite phase fraction increases but the elongated grain shape is formed at a position t/4 of a thickness just under a surface layer where the temperature is relatively low due to the ferrite phase transformation promotion, which may be a factor that rapidly propagates cracks, and the non-uniform microstructure may remain in the center of the thickness, which may adversely affect the durability.

Meanwhile, the hot rolling preferably starts at a temperature in the range of 800 to 1000° C. When the hot rolling starts at a temperature higher than 1000° C., the temperature of the hot-rolled steel sheet increases, so the grain size becomes coarse and the quality of the surface of the hot-rolled steel sheet deteriorates. On the other hand, when the hot rolling is performed at a temperature lower than 800° C., the elongated grains are developed due to the excessive recrystallization delay, resulting in severe anisotropy and poor formability, and when the rolling is performed at a temperature equal to or lower than the austenite temperature range, the non-uniform microstructure may be developed more severely.

In the present invention, the hot-rolled steel sheet is primarily cooled to a mid-temperature (MT) range of 550 to 650° C. to satisfy the following [Relational Expression 2].

$$CR1_{min} < CR1 < CR1_{max}$$

$$CR1_{min}=210-850[C]+1.5[Si]-67.2[Mn]-59.6[Cr]+187[Ti]+852[Nb]$$

$$CR1_{max}=240-850[C]+1.5[Si]-67.2[Mn]-59.6[Cr]+187[Ti]+852[Nb] \quad \text{[Relational Expression 2]}$$

$CR_1$ of the above Relational Expression 2 is a primary cooling rate (° C./sec) in an FDT to MT (550 to 650° C.) section,

[C], [Si], [Mn], [Cr], [Ti], and [Nb] in the above Relational Expression 2 are wt % of the corresponding alloy element.

As the temperature range from immediately after the hot rolling to a specific MT in the range of 550 to 650°, which is the first section, when the thickness of the rolled sheet exceeds 5 mm due to the temperature range where the ferrite phase transformation occurs during cooling, the cooling rate in the center of the thickness is slower than at the position t/4 under the surface layer of the thickness of the rolled sheet, so the coarse ferrite is formed in the center of the thickness, and the non-uniform microstructure is formed.

Therefore, immediately after the hot rolling, in the (FDT to MT) temperature region of the above Relational Expression 2, it is required to control the cooling rate to a specific cooling rate ($CR1_{min}$) or higher so that the ferrite phase transformation in the center of the thickness does not proceed excessively. However, it is necessary to limit the cooling rate to $CR1_{max}$ or less because it is difficult to secure an appropriate fraction of the ferrite phase during excessive quenching, and the elongation deteriorates.

Next, in the present invention, when the primarily cooled steel sheet is divided, in a lengthwise direction, into three parts: HEAD, MID, and TAIL parts, a region of the HEAD part and the TAIL part corresponding to the outer wound portion of a coil during coiling is secondarily cooled to a temperature range from 450 to 550° C. to satisfy the following [Relational Expression 3], and a region of the MID part corresponding to the inner wound portion of the coil is secondarily cooled to the temperature range from 400 to 500° C. to satisfy the following [Relational Expression 4], and then coiled;

$$CR2_{OUT\text{-}min} < CR2_{OUT} < CR2_{OUT\text{-}max}$$

$$CR2_{OUT\text{-}min}=14.5[C]+18.75[Si]+8.75[Mn]+8.5[Cr]+35.25[Ti]+42.5[Nb]-14$$

$$CR2_{OUT\text{-}max}=38.7[C]+50[Si]+23.3[Mn]+22.7[Cr]+94[Ti]+113.3[Nb]-37.4 \quad \text{[Relational Expression 3]}$$

$CR2_{OUT}$ of the above Relational Expression 3 is the secondary cooling rate (° C./sec) in MT to coiling temperature section of the HEAD part and the TAIL part,

[C], [Si], [Mn], [Cr], [Ti], and [Nb] in the above Relational Expression 3 are wt % of the corresponding alloy element $$CR2_{IN\text{-}min} < CR2_{IN} < CR2_{IN\text{-}max}$$

$$CR2_{IN\text{-}min} = 29[C]+37.5[Si]+17.5[Mn]+17[Cr]+20.5[Ti]+25[Nb]-28$$

$$CR2_{IN\text{-}max} = 211.5[C]+5.5[Si]+15[Mn]+6[Cr]+30.5[Ti]+41[Nb]+30.5 \quad \text{[Relational Expression 4]}$$

$CR2_{IN}$ of the Relational Expression 4 is the secondary cooling rate (° C./sec) of the MT to coiling temperature section of the MID part,

[C], [Si], [Mn], [Cr], [Ti], and [Nb] in the above Relational Expression 4 are wt % structure of the corresponding alloy element.

In the second section temperature range from the MT to the coiling temperature (CT), it is necessary to suppress the excessive formation of the MA phase, the carbide, the pearlite phase, and the martensite phase. However, in the case of thick material, the MID part of the hot-rolled sheet forming the inner wound portion of the coil after the coiling and the HEAD part and the TAIL part of the hot-rolled sheet forming the outer wound portion of the coil after the coiling have a large difference in heat recuperation and re-cooling behavior in the wound state. In particular, in the case of the MID part, it is relatively easy to generate the MA phase, the carbide, and the pearlite phase, and the deterioration phenomenon of the conventional low-temperature phase is also caused, resulting in deteriorating the durability.

Therefore, in the present invention, for the cooling rate $CR2_{OUT}$ of the second section for the HEAD part and the TAIL part of the hot-rolled sheet forming the outer wound portion of the coil after the coiling, and the cooling rate $CR2_{IN}$ of the second section for the MID part of the hot-rolled sheet forming the inner wound portion of the coil after the coiling, respectively, there is a need to performing the cooling to satisfy the set Relational Expressions 3 and 4 in consideration of the steel component.

Described in detail, when the cooling rate of both the inner/outer wound portions of the coil are slower than the specific cooling rates $CR2_{O\text{-}min}$ and $CR2_{I\text{-}min}$ respectively shown in each Relational Expression, the carbide is easier to form at the ferrite grain boundary than the bainite phase, and may be coarsely grown. In addition, when the cooling rate is very slow, the pearlite phase is formed, which makes it easy to form cracks during the shear forming or punching forming, and to propagate cracks along grain boundaries even with a small external force. On the other hand, when the cooling rate is faster than the specific cooling rate $CR2_{O\text{-}max}$ and $CR2_{I\text{-}max}$ shown in each Relational Expression, the MA phase or the martensite phase, which causes the hardness difference between the phases, is excessively formed, so it is easy to secure strength, but the elongation or durability deteriorate.

Taking this into consideration, in the present invention, when the primarily cooled steel sheet is divided, in the lengthwise direction, into the three parts: HEAD, MID, and TAIL parts, the region of the HEAD part and the TAIL part corresponding to the outer wound portion of the coil during the coiling is secondarily cooled to a temperature range from 450 to 550° C. to satisfy the following [Relational Expression 3], and the region of the MID part corresponding to the inner wound portion of the coil is secondarily cooled to the temperature range from 400 to 500° C. to satisfy the following [Relational Expression 4].

Thereafter, in the present invention, the wound coil may be air-cooled to a temperature ranging from room temperature to 200° C. The air cooling of the coil means cooling in the air at room temperature at a cooling rate of 0.001 to 10° C./hour. In this case, when the cooling rate exceeds 10° C./hour, some untransformed phases in the steel are easily transformed into the MA phase, and thus, the shear formability, punching formability, and durability of the steel deteriorate, and in order to control the cooling rate to less than 0.001° C./hour, it is economically disadvantageous because separate heating and thermal insulation facilities are required. Preferably, it is preferable to perform cooling at 0.01 to 1° C./hour.

Alternatively, in the present invention, the method may further include pickling and oiling the coiled steel sheet after the secondary cooling.

The method may further include heating the pickled or oiled steel sheet to a temperature range of 450 to 740° C., followed by hot-dip galvanizing.

In the present invention, the hot-dip galvanizing may use a plating bath including 0.01 to 30% by weight of magnesium (Mg), 0.01 to 50% by weight of aluminum (Al), the remaining of Zn, and inevitable impurities.

MODE FOR INVENTION

Hereinafter, the present invention will be described in more detail through Inventive Examples.

INVENTIVE EXAMPLE

TABLE 1

| Steel Type | C | Si | Mn | Cr | Al | P | S | N | Ti | Nb |
|---|---|---|---|---|---|---|---|---|---|---|
| 1 | 0.06 | 0.9 | 1.5 | 0.22 | 0.03 | 0.01 | 0.004 | 0.004 | 0.05 | 0.025 |
| 2 | 0.06 | 0.9 | 1.5 | 0.25 | 0.03 | 0.01 | 0.005 | 0.004 | 0.05 | 0.005 |
| 3 | 0.07 | 0.9 | 1.4 | 0.21 | 0.03 | 0.01 | 0.004 | 0.005 | 0.04 | 0.033 |
| 4 | 0.07 | 0.9 | 1.3 | 0.19 | 0.03 | 0.01 | 0.004 | 0.005 | 0.04 | 0.033 |
| 5 | 0.07 | 0.4 | 1.5 | 0.83 | 0.05 | 0.01 | 0.003 | 0.006 | 0.04 | 0.045 |
| 6 | 0.07 | 0.4 | 1.5 | 0.83 | 0.05 | 0.01 | 0.003 | 0.006 | 0.04 | 0.045 |
| 7 | 0.16 | 0.5 | 1.5 | 0.22 | 0.03 | 0.01 | 0.003 | 0.004 | 0.07 | 0.032 |
| 8 | 0.04 | 0.5 | 1.5 | 0.31 | 0.03 | 0.01 | 0.002 | 0.004 | 0.07 | 0.032 |
| 9 | 0.08 | 1.2 | 1.7 | 0.35 | 0.03 | 0.01 | 0.003 | 0.004 | 0.06 | 0.025 |
| 10 | 0.07 | 0.5 | 2.5 | 0.22 | 0.03 | 0.01 | 0.003 | 0.004 | 0.07 | 0.034 |
| 11 | 0.08 | 0.5 | 0.8 | 0.36 | 0.03 | 0.01 | 0.003 | 0.004 | 0.05 | 0.035 |
| 12 | 0.06 | 0.5 | 1.7 | 1.1 | 0.03 | 0.01 | 0.004 | 0.004 | 0.05 | 0.035 |
| 13 | 0.06 | 0.1 | 1.7 | 0.35 | 0.03 | 0.01 | 0.003 | 0.005 | 0.09 | 0.032 |
| 14 | 0.06 | 0.3 | 1.3 | 0.55 | 0.03 | 0.01 | 0.003 | 0.005 | 0.04 | 0.043 |
| 15 | 0.07 | 0.5 | 1.5 | 0.51 | 0.03 | 0.01 | 0.003 | 0.005 | 0.06 | 0.051 |
| 16 | 0.08 | 0.3 | 1.6 | 0.53 | 0.03 | 0.01 | 0.003 | 0.005 | 0.07 | 0.063 |
| 17 | 0.09 | 0.3 | 1.6 | 0.71 | 0.03 | 0.01 | 0.002 | 0.004 | 0.09 | 0.045 |
| 18 | 0.09 | 0.1 | 1.5 | 0.81 | 0.03 | 0.01 | 0.003 | 0.004 | 0.09 | 0.045 |
| 19 | 0.11 | 0.5 | 1.5 | 0.72 | 0.03 | 0.01 | 0.003 | 0.004 | 0.09 | 0.055 |

* In Table 1, units of alloy components are wt %, and the remaining components are Fe and inevitable impurities.

TABLE 2

| Steel Type | Division | Thickness (mm) | FDT (° C.) | CR1 (° C./sec) | MT (° C.) | $CR2_{OUT}$ (° C./sec) | $CR2_{IN}$ (° C./sec) | $CT_{OUT}$ (° C.) | $CT_{IN}$ (° C.) |
|---|---|---|---|---|---|---|---|---|---|
| 1 | Comparative Example 1 | 11 | 900 | 80 | 600 | 45 | 70 | 465 | 442 |
| 2 | Comparative Example 2 | 11 | 780 | 58 | 550 | 28 | 53 | 466 | 443 |
| 3 | Comparative Example 3 | 9 | 840 | 60 | 600 | 90 | 62 | 330 | 441 |
| 4 | Comparative Example 4 | 9 | 840 | 60 | 600 | 15 | 62 | 580 | 444 |
| 5 | Comparative Example 5 | 9 | 850 | 63 | 600 | 40 | 80 | 480 | 360 |
| 6 | Comparative Example 6 | 9 | 850 | 63 | 600 | 40 | 25 | 480 | 525 |
| 7 | Comparative Example 7 | 6 | 850 | 50 | 650 | 54 | 70 | 488 | 402 |
| 8 | Comparative Example 8 | 8 | 850 | 85 | 550 | 19 | 62 | 492 | 452 |
| 9 | Comparative Example 9 | 8 | 820 | 55 | 600 | 57 | 62 | 429 | 422 |
| 10 | Comparative Example 10 | 8 | 880 | 50 | 650 | 64 | 73 | 458 | 410 |
| 11 | Comparative Example 11 | 8 | 800 | 85 | 550 | 12 | 54 | 513 | 456 |
| 12 | Comparative Example 12 | 8 | 880 | 58 | 650 | 64 | 70 | 457 | 429 |
| 13 | Inventive Example 1 | 8 | 880 | 85 | 600 | 30 | 69 | 511 | 440 |
| 14 | Inventive Example 2 | 7 | 850 | 85 | 550 | 15 | 63 | 505 | 450 |
| 15 | Inventive Example 3 | 9 | 870 | 80 | 600 | 39 | 68 | 482 | 436 |
| 16 | Inventive Example 4 | 8 | 890 | 80 | 600 | 36 | 72 | 491 | 429 |
| 17 | Inventive Example 5 | 9 | 880 | 60 | 630 | 48 | 71 | 485 | 423 |
| 18 | Inventive Example 6 | 10 | 890 | 65 | 630 | 43 | 72 | 500 | 427 |
| 19 | Inventive Example 7 | 11 | 860 | 58 | 630 | 53 | 70 | 471 | 414 |

TABLE 3

| Steel | | Relational Expression 1 | Relational Expression 2 | | Relational Expression 3 | | Relational Expression 4 | |
|---|---|---|---|---|---|---|---|---|
| Type | Division | Tn | $CR1_{min}$ | $CR1_{max}$ | $CR2_{O\text{-}min}$ | $CR2_{O\text{-}max}$ | $CR2_{I\text{-}min}$ | $CR2_{I\text{-}max}$ |
| 1 | Comparative Example 1 | 817 | 77 | 107 | 22 | 57 | 39 | 75 |
| 2 | Comparative Example 2 | 805 | 58 | 88 | 21 | 56 | 39 | 74 |
| 3 | Comparative Example 3 | 814 | 81 | 111 | 21 | 55 | 37 | 75 |
| 4 | Comparative Example 4 | 806 | 89 | 119 | 20 | 52 | 35 | 73 |
| 5 | Comparative Example 5 | 897 | 47 | 77 | 18 | 48 | 31 | 78 |
| 6 | Comparative Example 6 | 897 | 47 | 77 | 18 | 48 | 31 | 78 |
| 7 | Comparative Example 7 | 878 | 1 | 31 | 17 | 44 | 28 | 94 |
| 8 | Comparative Example 8 | 868 | 98 | 128 | 16 | 41 | 26 | 70 |
| 9 | Comparative Example 9 | 823 | 41 | 71 | 31 | 82 | 57 | 84 |
| 10 | Comparative Example 10 | 938 | 12 | 42 | 24 | 64 | 43 | 90 |
| 11 | Comparative Example 11 | 819 | 107 | 137 | 10 | 26 | 15 | 67 |
| 12 | Comparative Example 12 | 913 | 19 | 49 | 24 | 63 | 43 | 81 |
| 13 | Inventive Example 1 | 926 | 68 | 98 | 11 | 30 | 16 | 75 |

TABLE 3-continued

| Steel | | Relational Expression 1 | Relational Expression 2 | | Relational Expression 3 | | Relational Expression 4 | |
|---|---|---|---|---|---|---|---|---|
| Type | Division | Tn | $CR1_{min}$ | $CR1_{max}$ | $CR2_{O\text{-}min}$ | $CR2_{O\text{-}max}$ | $CR2_{I\text{-}min}$ | $CR2_{I\text{-}max}$ |
| 14 | Inventive Example 2 | 879 | 83 | 113 | 12 | 31 | 19 | 71 |
| 15 | Inventive Example 3 | 887 | 75 | 105 | 18 | 48 | 30 | 78 |
| 16 | Inventive Example 4 | 925 | 70 | 100 | 16 | 44 | 26 | 81 |
| 17 | Inventive Example 5 | 929 | 39 | 69 | 18 | 48 | 29 | 84 |
| 18 | Inventive Example 6 | 941 | 40 | 70 | 14 | 38 | 21 | 82 |
| 19 | Inventive Example 7 | 912 | 37 | 67 | 22 | 58 | 36 | 88 |

The steel slab having the composition components shown in Table 1 was prepared. Then, the steel slab prepared as described above was hot-rolled, cooled and coiled under the conditions shown in Tables 2 and 3 to produce the coiled hot-rolled steel sheet. After the coiling, the cooling rate of the steel sheet was kept constant at 1° C./hour.

Table 2 showed the thickness t of the hot-rolled steel sheet, a finish hot-rolling temperature (FDT), the mid-temperature (MT), a coiling temperature (CT), a cooling rate CR1 in a first section (FDT to MT) after hot rolling, and cooling rates $CR2_{OUT}$ and $CR2_{IN}$ in a second section (MT to CT), respectively. Table 3 showed the calculation results of the Relational Expressions 1 to 4, respectively.

The microstructure of each hot-rolled steel sheet obtained as described above was measured by being divided into the inner wound portion and the outer wound portion of the coil, and the results were shown in Table 4 below. The steel microstructure is the result of analysis in the center of the thickness of the hot-rolled sheet, and the phase fractions of martensite (M), ferrite (F), bainite (B), and pearlite (P) were measured from the results of analysis at 3000 and 5000 magnifications using the scanning electron microscope (SEM). The area fraction of the MA phase was analyzed using an optical microscope and an image analyzer after etching by the Repeller etching method, and is the result of analysis at 1000 magnification.

In addition, for each hot-rolled steel sheet obtained as described above, mechanical properties were measured and durability was evaluated, and the results are shown in Table 5 below. In Table 5 below, YS, TS, YR, T-El, and $S_F$ mean 0.2% off-set yield strength, tensile strength, yield ratio, fracture elongation, and fatigue strength, and "O" and "I" meaning OUT and IN, were added to each item to divide the result values for the inner and outer wound parts.

Meanwhile, the above mechanical properties are the results of testing the JIS No. 5 standard specimen by taking the specimen in a direction perpendicular to the rolling direction. The evaluation result of the durability was obtained by punching a hole with a diameter of 10 mm in the center of the test piece under the condition of a clearance of 12% as a reference fatigue strength value of $N_f=10^5$. For the test piece, a test piece with a gauge length part of 40 mm and a width of 20 mm was used as a bending fatigue test, and the result is the result of testing under the conditions of a stress ratio of −1 and a frequency of 15 Hz.

TABLE 4

| | Structure of outer wound portion of hot-rolled coil | | | | | Structure of inner wound portion of hot-rolled coil | | | | |
|---|---|---|---|---|---|---|---|---|---|---|
| Division | F | B | M | MA | P | F | B | M | MA | P |
| Comparative Example 1 | 65 | 28 | 2 | 5 | 0 | 65 | 27 | 2 | 6 | 0 |
| Comparative Example 2 | 78 | 16 | 1 | 4 | 1 | 80 | 14 | 1 | 4 | 1 |
| Comparative Example 3 | 62 | 15 | 20 | 3 | 0 | 72 | 25 | 2 | 1 | 0 |
| Comparative Example 4 | 76 | 15 | 0 | 3 | 6 | 73 | 24 | 2 | 1 | 0 |
| Comparative Example 5 | 73 | 24 | 2 | 1 | 0 | 63 | 16 | 19 | 2 | 0 |
| Comparative Example 6 | 73 | 25 | 1 | 1 | 0 | 77 | 14 | 0 | 5 | 4 |
| Comparative Example 7 | 28 | 70 | 1 | 1 | 0 | 20 | 75 | 4 | 1 | 0 |
| Comparative Example 8 | 78 | 15 | 0 | 1 | 6 | 80 | 13 | 0 | 1 | 6 |
| Comparative Example 9 | 68 | 23 | 1 | 6 | 2 | 70 | 21 | 1 | 6 | 2 |
| Comparative Example 10 | 23 | 65 | 11 | 1 | 0 | 21 | 67 | 11 | 1 | 0 |
| Comparative Example 11 | 79 | 15 | 0 | 1 | 5 | 75 | 18 | 1 | 1 | 5 |
| Comparative Example 12 | 21 | 77 | 1 | 1 | 0 | 20 | 78 | 1 | 1 | 0 |
| Inventive Example 1 | 59 | 37 | 2 | 2 | 0 | 67 | 30 | 2 | 1 | 0 |
| Inventive Example 2 | 59 | 38 | 2 | 1 | 0 | 64 | 33 | 2 | 1 | 0 |
| Inventive Example 3 | 52 | 45 | 2 | 1 | 0 | 57 | 39 | 2 | 2 | 0 |
| Inventive Example 4 | 54 | 42 | 3 | 1 | 0 | 60 | 35 | 2 | 2 | 1 |
| Inventive Example 5 | 40 | 55 | 3 | 1 | 1 | 45 | 50 | 2 | 2 | 1 |
| Inventive Example 6 | 34 | 60 | 3 | 2 | 1 | 41 | 52 | 3 | 3 | 1 |
| Inventive Example 7 | 28 | 65 | 4 | 2 | 1 | 31 | 60 | 4 | 3 | 2 |

* In Table 4, F represents ferrite, B represents bainite, M represents martensite, and P represents pearlite.

TABLE 5

| Division | Physical property of outer wound portion of hot-rolled coil | | | | | Physical property of inner wound portion of hot-rolled coil | | | | |
|---|---|---|---|---|---|---|---|---|---|---|
| | $YS_O$ (MPa) | $TS_O$ (MPa) | $YR_O$ | $El_O$ (%) | $S_{F\text{-}O}$ (MPa) | $YS_I$ (MPa) | $TS_I$ (MPa) | $YR_I$ | $El_I$ (%) | $S_{F\text{-}I}$ (MPa) |
| Comparative Example 1 | 472 | 583 | 0.81 | 27 | 105 | 435 | 551 | 0.79 | 27 | 102 |
| Comparative Example 2 | 439 | 556 | 0.79 | 27 | 107 | 445 | 549 | 0.81 | 27 | 108 |
| Comparative Example 3 | 538 | 690 | 0.78 | 24 | 115 | 550 | 679 | 0.81 | 25 | 160 |
| Comparative Example 4 | 502 | 652 | 0.77 | 24 | 103 | 549 | 678 | 0.81 | 25 | 159 |
| Comparative Example 5 | 638 | 778 | 0.82 | 25 | 159 | 615 | 788 | 0.78 | 24 | 115 |
| Comparative Example 6 | 633 | 781 | 0.81 | 26 | 162 | 608 | 750 | 0.81 | 25 | 113 |
| Comparative Example 7 | 856 | 1031 | 0.83 | 11 | 220 | 920 | 1109 | 0.83 | 11 | 221 |
| Comparative Example 8 | 401 | 489 | 0.82 | 30 | 83 | 396 | 483 | 0.82 | 31 | 80 |
| Comparative Example 9 | 562 | 711 | 0.79 | 24 | 125 | 590 | 719 | 0.82 | 24 | 122 |
| Comparative Example 10 | 640 | 790 | 0.81 | 24 | 118 | 649 | 801 | 0.81 | 24 | 115 |
| Comparative Example 11 | 457 | 557 | 0.82 | 26 | 110 | 466 | 561 | 0.83 | 26 | 108 |
| Comparative Example 12 | 681 | 830 | 0.82 | 15 | 171 | 681 | 821 | 0.83 | 15 | 169 |
| Inventive Example 1 | 554 | 675 | 0.82 | 25 | 158 | 543 | 662 | 0.82 | 25 | 151 |
| Inventive Example 2 | 552 | 681 | 0.81 | 25 | 166 | 558 | 680 | 0.82 | 26 | 158 |
| Inventive Example 3 | 612 | 756 | 0.81 | 23 | 180 | 608 | 751 | 0.81 | 24 | 170 |
| Inventive Example 4 | 622 | 749 | 0.83 | 23 | 177 | 608 | 741 | 0.82 | 23 | 169 |
| Inventive Example 5 | 739 | 935 | 0.79 | 19 | 207 | 727 | 920 | 0.79 | 19 | 199 |
| Inventive Example 6 | 713 | 914 | 0.78 | 18 | 205 | 718 | 909 | 0.79 | 19 | 197 |
| Inventive Example 7 | 745 | 955 | 0.78 | 17 | 210 | 747 | 945 | 0.79 | 17 | 195 |

As shown in Tables 1 to 5, it could be seen that all of Inventive Examples 1 to 7 satisfying the manufacturing conditions including the component range and the above Relational Expressions 1 to 4 proposed in the present invention uniformly secure the target material and durability.

On the other hand, Comparative Example 1 is a case in which the hot rolling temperature exceeds the range of Relational Expression 1 proposed in the present invention, and showed that the MA phase develops in the microstructure in the center and the area of the grain boundary becomes coarse, and as a result, microcracks are easily formed in the cross section when exposed to the fatigue environment, resulting in deteriorating the fatigue characteristics.

Comparative Example 2 is a case where hot rolling temperature was less than the range of the above Relational Equation 1, the elongated grains were formed excessively in the center of the thickness due to hot rolling in a low temperature range, and as a result, the fatigue fracture occurs along weak grain boundaries. This is because the microcracks formed in the center of the thickness during the punching forming developed along the elongated ferrite grain boundary.

Comparative Examples 3 and 4 are cases in which cooling conditions are not satisfied in the outer wound portion of the coil, that is, the HEAD part and the TAIL part of the hot-rolled sheet in the Relational Expression 3 proposed in the present invention. Specifically, Comparative Example 3 could confirm that, due to the relative rapid cooling control, as shown in Table 4, the martensite phase is excessively formed in the structure and the durability deteriorates due to the difference in hardness between the phases. Comparative Example 4 is a case of slow cooling control, and could confirm that it is difficult to secure sufficient bainite phase in the structure, and the pearlite phase fraction is high and the durability deteriorates.

Comparative Examples 5 and 6 are cases in which the cooling condition of the inner wound portion of the coil, that is, the MID part of the hot-rolled sheet, is not satisfied in Relational Expression 3 proposed in the present invention, and the durability was not good due to a metallurgical phenomenon similar to that of Comparative Examples 3 and 4.

On the other hand, Comparative Examples 7 and 12 showed steels that did not satisfy the component range of the present invention, and Comparative Example 7 showed a region in which the C content is excessively contained, and thus, the range of CR1 for securing an appropriate fraction of ferrite phase needs to be controlled to 31° C./sec or lower, but may not be controlled when considering the length of the rolling and cooling section of the actual facility. In addition, it was not easy to secure sufficient formability because the elongation decreased due to the formation of the excessive bainite phase in the structure.

Comparative Example 8 is a case in which the C content was lower than the target, and showed that the low-temperature transformation phases such as bainite, including the martensite phase, were not sufficiently developed in the center of the thickness of the steel sheet, and a relatively coarse ferrite phase was formed, resulting in lowering the fatigue strength.

Comparative Example 9 is a case in which the Si content is excessively high, and showed that the excessive MA phase is formed in the structure, and thus the hardenable property in a local area causes the difference in hardness between the phases and the surrounding base structure, thereby facilitating the occurrence of cracks in the fatigue environment and lowering the fatigue strength. In addition, excessive Si addition increases the probability of occurrence of red scale on the surface of the thick material, which is undesirable in terms of the use of wheel rim parts.

Comparative Example 10 is a case in which the Mn content is excessively added, and showed that the martensite phase is developed excessively along the Mn segregation zone developed in the center of the thickness, and the shear and punching quality deteriorates, and thus, it is difficult to secure sufficient fatigue strength.

Comparative Example 11 is a case in which the Mn content is added low, and could confirm that the composite-phase steel is prepared to satisfy Relational Expressions 1 to 4 for a recrystallization delay effect and a uniform microstructure, and both strength and fatigue strength are low because there are too few untransformed regions after ferrite phase transformation in the center of the thickness, result in making it difficult to secure a sufficient low-temperature transformation phase.

Comparative Example 12 showed that the Cr content was excessively high, and similarly to Comparative Example 10, a lot of martensite phases formed locally in the center of the thickness were observed, and the fatigue characteristics deteriorate.

FIG. 1 is a diagram illustrating a product of the tensile strength, elongation, and fatigue strength of the outer wound portion and the inner wound portion according to Inventive Examples and Comparative Examples of the present invention as described above. As illustrated in FIG. 1, the case of Inventive Examples 1 to 7 of the present invention that satisfy the alloy composition and manufacturing process conditions of the present invention could confirm that the composite-phase steel with excellent material and durability uniformity may be obtained, in which the product of tensile strength, elongation, and fatigue strength of the outer wound portion is $25\times10^5$% or greater, and the product of the tensile strength, elongation, and fatigue strength of the inner wound portion is $24\times10^5$% or greater.

The present invention is not limited to the above implementation examples and examples, but may be manufactured in a variety of different forms, and those of ordinary skill in the art to which the present invention pertains will understand that the present invention may be implemented in other specific forms without changing the technical spirit or essential features of the present invention. Therefore, it is to be understood that the implementation examples and examples described above are illustrative rather than being restrictive in all aspects.

The invention claimed is:

1. A composite phase steel having excellent material and durability uniformity and a thickness of 5 mm or more, the composite-phase steel comprising:

by wt %, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, and a balance of Fe and inevitable impurities; and a microstructure comprising: a mixed phase of ferrite and bainite as a base structure; a pearlite phase; a martensite and austenite (MA) phase; and a martensite phase, wherein an area fraction of each of the pearlite phase and the martensite and austenite (MA) phase is less than 5%, and an area fraction of the martensite phase is less than 10%, wherein, when a coil in a wound state is divided, in a lengthwise direction, into three parts: head, mid, and tail parts, a product of tensile strength, elongation, and fatigue strength of an outer wound portion of the coil, which is a region of the head part and the tail part, is $25\times10^5$ $MPa^2\cdot$% or greater, and a product of tensile strength, elongation, and fatigue strength of an inner wound portion of the coil, which is a region of the mid part, is $24\times10^5$ $MPa^2\cdot$% or greater.

2. The composite-phase steel of claim 1, wherein an area fraction of each of the ferrite and the bainite is less than 65%.

3. The composite-phase steel of claim 1, wherein the composite-phase steel is a pickled and oiled (PO) steel sheet.

4. The composite-phase steel of claim 1, wherein the composite-phase steel is a hot-dip galvanized steel sheet having a hot-dip galvanized layer formed on at least one surface thereof.

* * * * *